US007434268B2

(12) United States Patent
Futch

(10) Patent No.: US 7,434,268 B2
(45) Date of Patent: Oct. 14, 2008

(54) PROTECTIVE HEADGEAR FOR RODEO ROUGH STOCK RIDING COMPETITION

(75) Inventor: Morris E. Futch, San Antonio, TX (US)

(73) Assignee: Dura Bull, Inc., San Antonio, TX (US)

( * ) Notice: Subject to any disclaimer, the term of this patent is extended or adjusted under 35 U.S.C. 154(b) by 188 days.

(21) Appl. No.: 11/084,229

(22) Filed: Mar. 18, 2005

(65) Prior Publication Data

US 2006/0206976 A1 Sep. 21, 2006

(51) Int. Cl.
*A42B 1/00* (2006.01)

(52) U.S. Cl. ..... 2/9; 2/424; 2/425

(58) Field of Classification Search ..... 2/9, 2/6.3, 424, 425, 6.7
See application file for complete search history.

(56) References Cited

U.S. PATENT DOCUMENTS 3,139,624 A * 7/1964 Humphrey ..... 2/9
5,249,347 A * 10/1993 Martinitz ..... 29/460
5,477,565 A * 12/1995 Hunt, Jr. ..... 2/423
5,502,843 A * 4/1996 Strickland ..... 2/424
5,893,174 A * 4/1999 Primeau ..... 2/424
6,598,234 B1 * 7/2003 Brown et al. ..... 2/9
6,772,447 B2 * 8/2004 Morrow et al. ..... 2/424
2001/0054189 A1 * 12/2001 Halstead et al. ..... 2/9
2002/0174480 A1 * 11/2002 Lombard ..... 2/424

* cited by examiner

*Primary Examiner*—Katherine Moran
(74) *Attorney, Agent, or Firm*—Mark Tidwell; Jackson Walker L.L.P.

(57) ABSTRACT

A protective headgear specifically for rodeo rough stock riding competition that protect the riders from serious injuries to the head and neck area. The protective headgear includes a helmet, a detachable face guard having horizontal bars spaced no more than approximately 1", and preferably, ⅞" apart, and a hard shell chin guard that preferably is loosely and adjustably attached to the face guard. Features of the protective headgear that make it suitable for rodeo competition include a detachable face guard that does not protrude below the chin to permit the rider to assume the required rough stock riding position in which the rider tucks his chin firmly down into his chest and horizontal bars with spacing that does not exceed approximately 1", and preferably, ⅞" apart.

12 Claims, 3 Drawing Sheets

PROTECTIVE HEADGEAR FOR RODEO ROUGH STOCK RIDING COMPETITION

FIELD OF INVENTION

The present invention generally relates to protective headgear useful in rough stock riding. More particularly, this invention relates to lightweight protective headgear useful to riders of rough stock in rodeo competitions including bull riding, bareback horse riding, and bucking bronco riding.

BACKGROUND OF THE PRIOR ART

Rodeo competitors generally do not use protective headgear in rough stock riding competitions, including professional, collegiate, high school and youth rodeos. As such, rodeo competitors often suffer serious injuries to the head and face at distressingly high frequencies. These injuries are often caused by ground impact as a result of falling off the animals and collisions with the animals, which are endemic to the sport. Starting July 1995, the National High School Rodeo Association, the organization which governs high school rodeo competition, has strongly suggested that suitable headgear should be worn by rodeo rough stock competitors. The professional and collegiate rodeos may soon follow this suggestion upon its success.

The causes of head and face injuries that may be incurred in rough stock riding are well-known in the industry. These injuries include injuries to the head and face by high velocity ground impact when thrown from or falling off an animal, by being stomped on or horn hooked by an animal after a rider has fell or been thrown to the ground, by smashing a rider's face into the back of a bucking animal's head, by blows of an animal's horn to a rider's head, or by being hit in the head from a fence or chute gate. Each one of these, and particularly the combination of all of these types of injuries are particularly unique to the sport and require unique equipment to suitably protect a rider.

Protective headgears that are currently being produced for some sports, including bicycling, hockey, boxing, motorcycling, football, baseball, and lacrosse, are not suitable as a protective headgear for rodeo competition. Rodeo rough stock riding competition imposes unique requirements on protective headgear that is not satisfied by the currently available protective headgears. For example, baseball helmets typically only protect the side of a wearer's head. Hockey masks typically are provided with a clear faceplate that can render the helmet uncomfortably hot, particularly when worn in off-ice environments. The face guard of a hockey mask would hinder a rough stock rider's ability to perform because the rider would not be able to attain a chin tuck position, as needed by rough stock riders. Biking helmets typically protect only the top of a wearer's head. Finally, football and boxing helmets have gaps that leave a wearer's face partially exposed to objects that could poke through the gaps. The unique requirements of rough stock riding are likewise derived from the additional requirements that the rodeo competitor must compete effectively, there are weight limitations on the headgear so as to promote effective competition, and the protective headgear provides safety to the rider during competition. Currently available protective headgears are not suitable for rodeo competition because they interfere with the ability of the rider to compete effectively, they are too heavy, they have too many obstructions within the rider's field of vision, and they do not provide adequate protection from the animal's horns and hooves. Thus, there is a present need for protective headgear that is specifically designed for the rodeo rough stock riding competitor that not only protects the rider, but also permits the rider to feel unfettered and unrestricted so that the protective headgear does not diminish his performance.

SUMMARY OF THE INVENTION

The present invention is directed toward protective head gear which provides head protection for rodeo rough stock riding competitors without diminishing the rider's performance. The headgear of this invention is comprised of a lightweight and tough protective helmet, a lightweight, yet sturdy, detachable face guard which is firmly attached to the helmet but detaches when the face guard is caught by an animal's hoof or horn so as to avoid injuries caused by the twisting and pulling of the rider's neck and has horizontal bars spaced no more than approximately 1", and preferably ⅞", apart, and a hard shell chin guard that is optionally, but preferably, loosely attached to the face guard and has a shock absorbing foam insert.

The protective headgear of the present invention is distinguished from currently available protective headgears by several critical features which permit the rodeo competitor to compete without restricting or interfering with the rider's performance while continuing to protect the rider from head injuries caused by falls and collisions with the rough stock animal.

First, the face guard of the present invention does not protrude below the rider's chin. The required stance of the rodeo rough stock rider while mounted on the animal during the competition is to tightly tuck his chin down to his chest. Thus, the present invention allows the rider to tuck his chin tightly against his chest, in accordance with the required riding position.

Second, the face guard of the present invention has only one vertical bar in the rider's field of vision, the center vertical bar which bisects the face guard. The objects within the rider's field of vision must be minimized so that the rider's performance is not diminished. This center vertical bar of the present invention is necessary for additional support of the horizontal bars, such that the horizontal bars are not substantially flexed during the impact of an animal's horns. The only other vertical bars, the side vertical bars, are at the sides of the protective headgear, which corresponds to the location of the rider's temples. These side vertical bars have no impact in the rider's field of vision.

Third, the face guard of the present invention has more protective cage than the face guards of other currently available protective headgears, thereby protecting the rider's head area from impact on all sides. The cage of the present invention includes an angled out portion at its bottom area to allow the rider to attain the chin tuck position.

Significantly, the protective horizontal bars are spaced no more than approximately 1", and preferably ⅞", apart in order to stop a hoof or horn from entering the face guard. It has been found that in the sport of bull riding at all levels, whether professional, collegiate, high school, or youth, the end or tip of a bulls horn must be larger than the diameter of a half dollar, or approximately 1¼" diameter.

The protective headgear of the present invention also includes a hard shell chin guard which is optionally, but preferably, loosely attached to the face guard and has a shock absorbing foam insert. Finally, the headgear's materials and components are selected so that the total weight of the headgear of the present invention is less than 40 ounces, preferably less than 30 ounces. According to the inventor's personal experience, rough stock riding performance deteriorates when the rider uses a protective headgear that weighs more than 40 ounces.

These and other features, aspects, and advantages of the present invention are presented in the following description, claims and accompanying drawings.

DETAILED DESCRIPTION OF THE INVENTION

Figure 1:
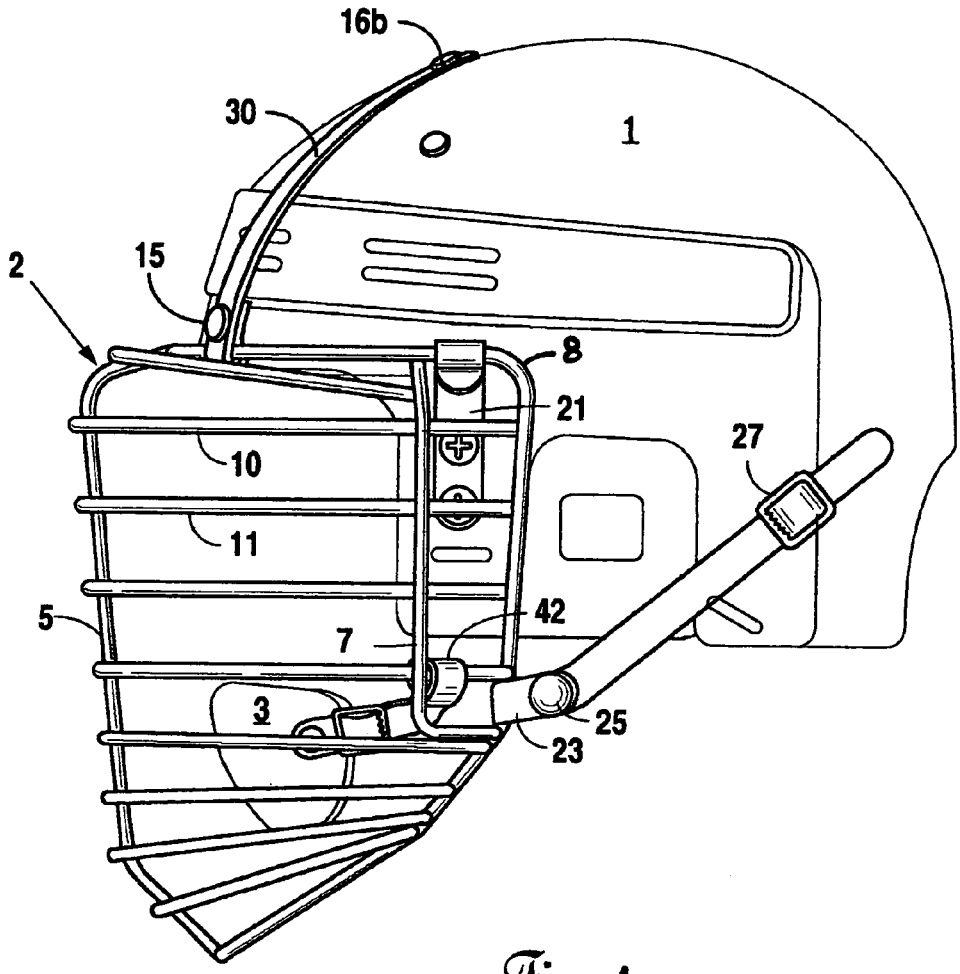
FIG. 1 is a side perspective view of the headgear with the face guard and chin guard assemblies attached.
Figure 2:
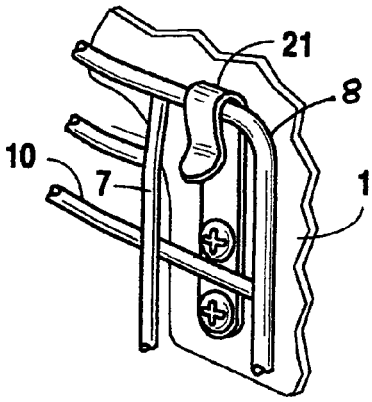
FIG. 2 is a detailed view of the attachment of the face guard assembly to the helmet.
Figure 3:
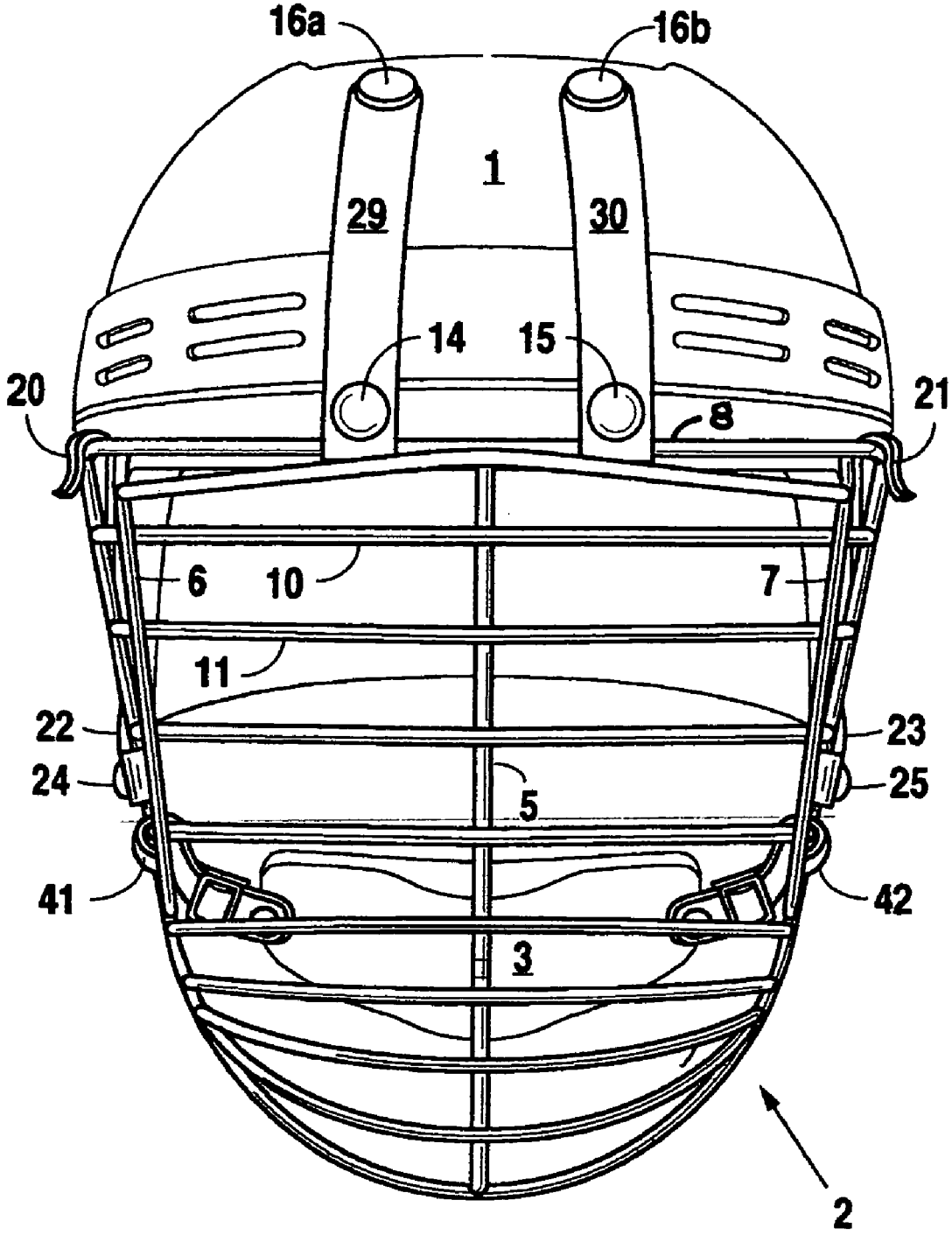
FIG. 3 is a frontal perspective view of the headgear with the face guard and chin guard assemblies attached.
Figure 4:
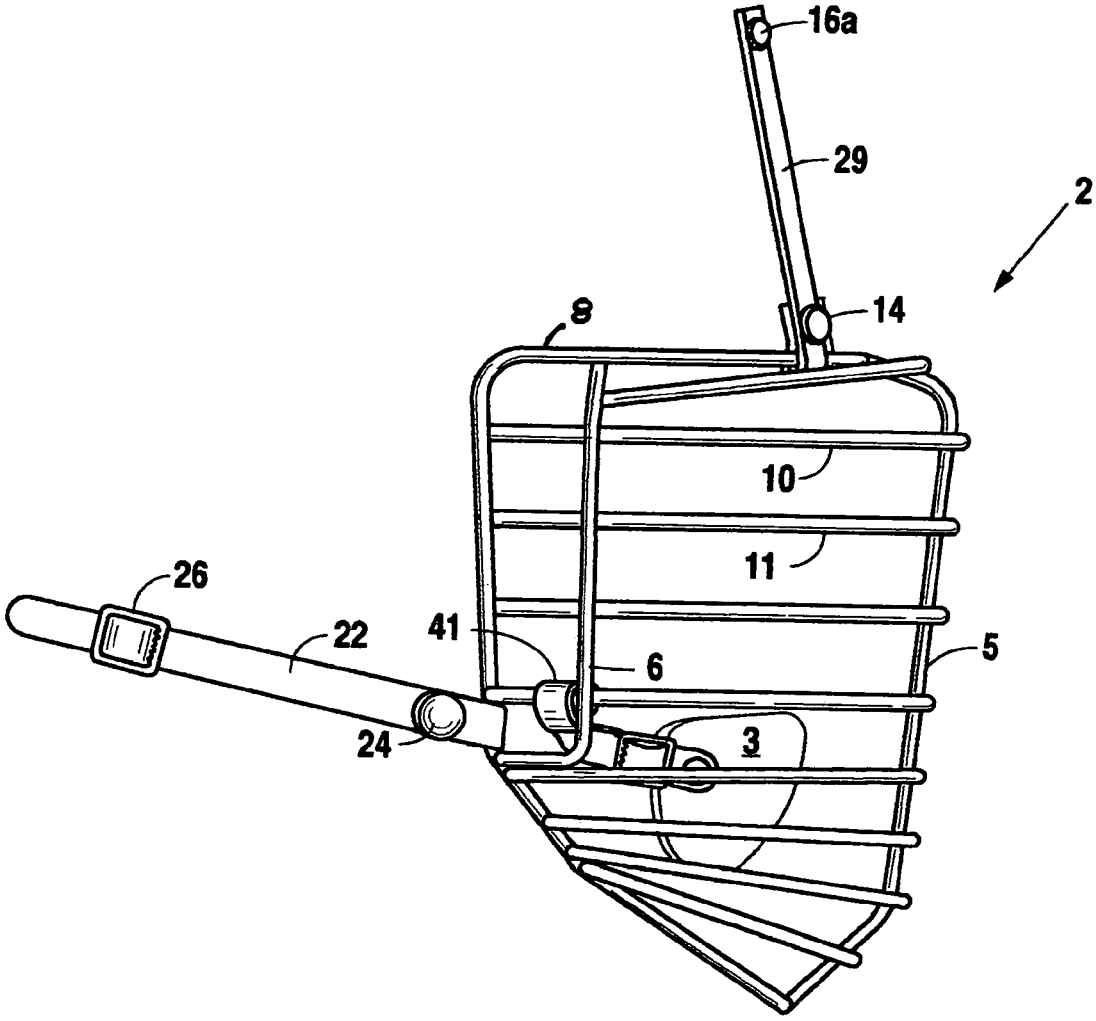
FIG. 4 is a detailed view of the straps used for the face guard and chin guard assemblies.

As illustrated in FIG. 1, the protective headgear of the present invention is comprised of a helmet 1, a face guard 2, and a chin guard 3.

The helmet 1 of the present headgear invention can be the protective helmet used by ice hockey linesman produced by I-Tech Company or an equivalent helmet. The helmet 1 protects and encases the top, sides, and back of the rider's head including the top half of the rider's temple area and ears. Typically, the helmet 1 is molded from a light, but mechanically tough, and strong engineered polymer. The inside of the helmet 1 is typically lined with foam padding at appropriate locations to cushion the rider's head against impact shocks and blows. The helmet 1 typically weighs about 16 ounces.

Also as illustrated in FIG. 1, the face guard 2 is a structurally rigid grid comprised of horizontal and vertical wire or bar stock, typically 3/16" diameter titanium, or other suitable strong material, such as light metal or plastic bar stock. The horizontal bars are attached to the right and left sides of the frame 8 of the face guard. In one preferred embodiment, the horizontal and vertical bars are curved so that face guard 2 is shaped to fit over the rider's face such that it cups the rider's face and nose. The face guard 2 of the present invention has more protective cage than the face guards of other currently available protective headgears, thereby making the face guard 2 stronger and protecting the rider's head area from impact on all sides. The cage of the present invention includes an angled out portion at its bottom area to allow the rider to attain the chin tuck position. The face guard 2 has structural strength to protect the rider's face from high velocity ground impact when thrown from or falling off an animal, being stomped on or horn hooked by an animal after a rider has fell or been thrown to the ground, smashing of a rider's face into the back of a bucking animal's head, blows of an animal's horn into a rider's head, or being hit in the head by a fence or chute gate. If a face guard material that is prone to corrosion is selected, then it is preferred that the bar stock be treated or coated with a rust protective material, such as zinc, plastic, paint, or powder coat.

The face guard 2 has a horizontal bar spacing, the space between horizontal bars 10 and 11, that does not exceed more than approximately 1", and preferably 7/8", apart. Typically, any horns of any bull used in competition at any level must be blunted to the size of a half dollar, or approximately 1¼" diameter. The bar spacing of the instant invention would minimize the tip of a bull's horn from protruding into the face guard 2 to an extent that could harm a competitor. It has been found that any greater spacing than 1" could permit a bull's horn, even blunted to 1¼" diameter, to protrude sufficiently to contact the rider. The protective headgear of the present invention has only one center vertical bar 5 in the rider's line of sight, which vertically bisects the rider's face at his nose. Preferably, center vertical bar 5 is also curved to fit around a wearer's face. The center vertical bar 5 is attached to the frame 8 of the face guard and to each horizontal bar. Center vertical bar 5 inhibits objects, such as a bull's horn, that may protrude between all horizontal bars from substantially flexing said horizontal bars upon impact. The face guard 2 has vertical side bars 6, 7, other vertical bars, that are not located in the rider's line of sight. These vertical side bars 6, 7 are formed as L shaped bars that are welded to the side and the top portion of the frame 8 of the face guard 2. The vertical side bars 6, 7 help brace the face guard 2 from a frontal or side impact blow in the event of a foreign obstacle striking the face guard with significant force.

Since the spacing between all horizontal bars shall not exceed more than approximately 1", and preferably 7/8", and the tip of a bull's horn must be equal to or greater than the size of a half dollar, approximately 1¼" diameter, the face guard 2 with its vertical side bars 6, 7 and its center vertical bar 5 would minimize harmful penetration of the tip of a bull's horn within the interior space of the protective headgear.

The total weight of the protective headgear is less than approximately 40 ounces, and preferably less than approximately 30 ounces. The helmet 1 weighs about 16 ounces, thus leaving about 14 to 24 ounces for the face guard 2. The preferred material for the face guard 2 is 3/16" titanium bar stock which provides adequate strength and adds only about 14 to 16 ounces to the protective headgear, making the total weight of the protective headgear about 30 to 32 ounces, which is ideal. Alternatively, but less preferable, steel bar stock may be used to construct the face guard 2. The steel face guard 2 weighs about 20 to 24 ounces, which would make the total weight of the protective headgear about 36 to 40 ounces, which is still acceptable.

The face guard 2 is detachably attached to the helmet 1. First, the face guard 2 is detachably attached to the helmet by straps 22, 23, which wrap around the bottom of vertical side bars 6, 7, using snap buttons 24, 25. These snap buttons 24, 25 are located on the front side of straps 22, 23 and attach to straps 22, 23. The back ends of straps 22, 23 are detachably attached to the helmet 1 using belt buckle type fasteners which double as a female snap 26, 27. Second, additional straps 29, 30 with snap buttons 14, 15, **16*a*, 16*b* are also used to detachably attach the face guard 2 to the helmet 1. Snap buttons 14, 15 are detachably attached to the end portion of straps 29, 30, once straps 29, 30 have looped around the top side of the frame 8 of the face guard 2. Snap buttons 16*a*, 16*b* are detachably attached to the top potion of helmet 1. Finally, the frame 8 of the face guard 2 is also removably secured to stabilizer brackets 20, 21. The stabilizer brackets 20, 21 are preferably made of a strong stainless steel material designed with a gripping pinching force to stabilize the face guard 2 near the temporal regions at the top on both sides of the frame 8 of the face guard 2. If the rider becomes dislodged and the face guard 2 is hooked by the animal's horns or entangled in the animal's hooves causing the jerking motion of the rider's head, the face guard 2 would detach from the helmet 1 by automatically unsnapping snap buttons 24, 25, 26, 27, as a result of the jerking motion, so that straps 22, 23, 29, 30 can slide away from the helmet 1 and the face guard 2 automatically is removed from stabilizer brackets 20, 21**. This detachable feature precludes injuries to the rider's neck caused by the jerking motions.

Finally, the chin guard 3 is made of hard shell plastic and a suitable shock resistant compressible foam insert that is mounted inside the chin guard 3. The chin guard 3 is loosely and adjustably secured to the face guard 2 by two or more adjustable straps 41, 42 that fit around vertical side bars 6, 7 at the lower right and left sides of the face guard 2.

While the preferred embodiment of the present invention and its advantages have been described in detail, it is appreciated that various changes, substitutions and alterations can be made without departing from the scope and spirit of the invention as defined by the following claims.

What is claimed is:

1. A protective headgear for a rider of rodeo rough stock riding competition, the headgear comprising:

a helmet, said helmet comprising a shell configured for fitting closely about the top, back, and sides of the head, said helmet shell including a frontal face opening defined by an upper brow edge, a left coverage area having a left forward edge and a right coverage area having a right forward edge;

a chin strap attached to said headgear adjacent a portion of said frontal face opening;

a face guard for attaching across said frontal face opening of said helmet shell, said face guard, when disposed across said frontal face opening comprising:

a center vertical bar bisecting said frontal face opening and having a first end and a second end, said first end located adjacent said upper brow edge and protruding out and away from the brow edge and said second end extending to a position below said chin strap and angled back toward the helmet;

a plurality of spaced apart horizontal bars having a spacing of no more than about one inch therebetween attached along the length of said vertical bar between said first and second ends of said vertical bar so as to overlay substantially all of said frontal face opening;

a top horizontal bar having a first end and a second end and disposed adjacent the upper brow edge of the helmet, the first end of the top horizontal bar adjacent the left forward edge of the helmet and the second end of the top horizontal bar adjacent the right forward edge of the helmet, said top horizontal bar attached to the first end of said vertical bar;

wherein said face guard is attached to said helmet by a face guard release mechanism comprising at least two stabilizer brackets and plurality of automatically releasable fasteners capable of releasing upon application of a release force so that said face guard is detachable upon a force being applied to said face guard, a first stabilizer bracket attached to said helmet adjacent the first end of the top horizontal bar and a second stabilizer bracket attached so said helmet adjacent the second end of the top horizontal bar, each of said brackets having a downward facing opening, each of said ends of said top horizontal bar seated in the downward facing opening of said respective stabilizer bracket, thereby preventing upward movement of the faceguard relative to the helmet.

2. The protective headgear of claim 1 wherein said face guard is made of titanium.

3. The protective headgear of claim 1 wherein said automatically releasable fasteners are snap buttons.

4. The protective headgear of claim 1 wherein said attachment bracket comprises a J-shaped bracket body having a first end and a second end, the first end of which is provided with a fastener aperture for fastening the attachment bracket to the helmet and the second end of which forms said downward facing opening and is curved to engage the top horizontal bar and apply a biasing force thereto, said second end securing said top horizontal bar when seated in said downward facing opening.

5. The protective headgear of claim 1 wherein said protective headgear comprises no more than one center vertical bar protruding out and away from the brow edge.

6. The protective headgear of claim 1, further comprising a left vertical side bar adjacent the left forward edge of the helmet and a right vertical side bar adjacent the right forward edge of the helmet, wherein said plurality of spaced apart horizontal bars are each defined by two distal ends, a first end of which attaches to said left vertical side bar and a second end of which attaches to said right vertical side bar, wherein said center vertical bar attaches to each of said plurality of spaced apart horizontal bars between said two distal ends so as to substantially bisect each of said spaced apart horizontal bars.

7. The protective headgear of claim 1 wherein said face guard release mechanism further comprises a plurality of straps, each strap having a first end attached to said face guard and a second end attached to said helmet utilizing one of said automatically releasable fasteners so as to removably attach said helmet to the face guard.

8. The protective headgear of claim 7 wherein said straps are made of plastic.

9. The protective headgear of claim 7 wherein said straps are made of nylon.

10. A protective headgear for a rider of rodeo rough stock riding competition comprising:

a helmet, said helmet symmetrical about a centerline bisecting the helmet and comprising a shell configured for fitting closely about the top, back, and sides of the head, said helmet shell including a frontal face opening defined by a left head coverage area having a left forward edge, a right head coverage area having a right forward edge, and an upper brow edge disposed symmetrically about the centerline, and intersecting each of said right and left forward edges;

a chin strap attached to said headgear adjacent a lower portion of said frontal face opening;

a chin guard attached to said chin strap;

a detachable face guard for attaching across said frontal face opening of said helmet shell, said face guard, when disposed across said frontal face opening comprising:

a center vertical bar bisecting said frontal face opening and having a first end and a second end and a substantially vertical portion therebetween, said first end located adjacent said upper brow edge at said centerline and protruding out and away from said upper brow edge, said second end extending to a position below said chin strap, said second end angled back toward said frontal face opening so as to provide protection to the lower portion of said frontal face opening and a plurality of spaced apart, substantially horizontal bars attached along a significant portion of the vertical portion of said center vertical bar so as to be substantially perpendicular to said vertical portion, wherein said center vertical bar is located within said rider's field of vision and wherein no other vertical obstructions forming said headgear are located within the rider's field of vision; and a face guard release mechanism comprising at least one downward-facing, J-shaped stabilizer bracket positioned along said upper brow edge on either side of said centerline, said J-shaped bracket including a curved portion that faces downward and biasing back towards itself to form a clip, said clip releasably engaging a horizontal bar adjacent said upper brow edge, at least two automatically releasable fasteners capable of releasing upon application of a release force, and at least two straps, each strap having a first end attached to said face guard and a second end attached to said helmet utilizing one of said automatically releasable fasteners so as to removably secure said face guard to said helmet.

11. The protective headgear of claim 10, wherein said automatically releasable fasteners of said face guard release mechanism are snap buttons, wherein one of said snap buttons is affixed to said helmet on said left head coverage area and one of said snap buttons is affixed to said helmet on said right head coverage area.

12. A protective headgear for a rider of rodeo rough stock riding competition, the headgear comprising:

a. a helmet, said helmet comprising a shell configured for fitting closely about the top, back, and sides of the head, said helmet shell including a frontal face opening defined by a left head coverage area having a left forward edge, a right head coverage area having a right forward edge, and a vertical upper brow edge extending from the right head coverage area to the left head coverage area and intersecting each of said right and left forward edges;

b. a chin strap attached to said headgear adjacent a portion of said frontal face opening;

c. a face guard for attaching across said frontal face opening of said helmet shell, said face guard, when disposed across said frontal face opening comprising:

(i) a center bar vertically bisecting said frontal face opening and having a first end, a second end and a substantially vertical portion therebetween, said first end located adjacent said upper brow edge and protruding out and away from the brow edge and said second end extending to a position below said chin strap and below said right and left head coverage areas of said helmet, said second end of said center bar angled back toward the helmet;

(ii) a plurality of bars spaced apart horizontally from one another and having a spacing of no more than about one inch therebetween, said plurality of bars attached along the length of said vertical portion of said center bar between said first and second ends of said center bar;

(iii) a top horizontal bar having a first end and a second end and disposed adjacent the upper brow edge of the helmet, the first end of the top horizontal bar adjacent the left head coverage area of said helmet and the second end of the top horizontal bar adjacent the right head coverage area of said helmet, wherein said center bar is attached to the top horizontal bar at a point between said first and second ends of said top horizontal bar so as to substantially bisect said top horizontal bar; and d. a face guard release mechanism comprising at least two downward-facing, J-shaped stabilizer brackets, one bracket positioned adjacent said upper brow edge on each of said head coverage areas of said helmet, said J-shaped brackets including a curved portion that faces downward and biasing back towards itself to form a clip, said clip releasably engaging said top horizontal bar adjacent said upper brow edge, at least two snap buttons capable of releasing upon application of a release force, and at least two straps, each strap having a first end attached to said face guard and a second end attached to said helmet utilizing one of said snap buttons so as to removably secure said face guard to said helmet.

* * * * *